US006560945B1

(12) United States Patent
Carpenter

(10) Patent No.: US 6,560,945 B1
(45) Date of Patent: May 13, 2003

(54) DEVICE FOR UNIFORM SHINGLE ATTACHMENT TO ROOF HIP, RIDGE AND BARGE RAFTER

(76) Inventor: Ronald Carpenter, 927 Coral Dr., Rodeo, CA (US) 94572

( * ) Notice: Subject to any disclaimer, the term of this patent is extended or adjusted under 35 U.S.C. 154(b) by 0 days.

(21) Appl. No.: 09/245,698

(22) Filed: Feb. 6, 1999

(51) Int. Cl.[7] ..... E04D 15/02

(52) U.S. Cl. ..... 52/749.12; 52/387; 52/543; 52/520; 52/551; 33/648; 33/649; 248/237

(58) Field of Search ..... 52/749.12, 746.11, 52/748.1, 57, 385, 387, 519, 520, 528, 543, 545, 551, 553, 105; 248/237; 33/648–649, 494

(56) References Cited

U.S. PATENT DOCUMENTS

| | | | | | |
|---|---|---|---|---|---|
| 1,642,088 | A | * | 9/1927 | Scarff | 52/54 |
| 1,890,928 | A | * | 12/1932 | Black | 52/551 X |
| 3,236,932 | A | * | 2/1966 | Grigas et al. | 52/551 X |
| 4,400,918 | A | * | 8/1983 | Lewis | 52/528 X |
| 4,577,442 | A | * | 3/1986 | Callaway | 52/57 |
| 4,920,721 | A | * | 5/1990 | Pressutti et al. | 52/518 |
| 5,247,771 | A | * | 9/1993 | Poplin | 52/518 |
| 5,271,201 | A | * | 12/1993 | Noone et al. | 52/518 |
| 5,471,801 | A | * | 12/1995 | Kupczyk et al. | 52/57 |
| 5,687,539 | A | * | 11/1997 | Bond | 52/748.1 |
| 5,933,976 | A | * | 8/1999 | Pressutti et al. | 33/648 |
| 6,039,646 | A | * | 3/2000 | Sells | 52/57 X |
| 6,105,331 | A | * | 8/2000 | Rinklake et al. | 52/550 |

FOREIGN PATENT DOCUMENTS

| | | | | |
|---|---|---|---|---|
| FR | 2618174 | * | 1/1989 | 33/648 |

* cited by examiner

*Primary Examiner*—Lanna Mai
*Assistant Examiner*—Winnie Yip
(74) *Attorney, Agent, or Firm*—Donn K. Harms

(57) ABSTRACT

An apparatus for the attaching of shingles to a roof and especially to the hip, ridge, and barge rafter edge portions of a shingled roof. The device can provide both a mounting guide to aid the user to achieve an in-line installation of conventional roofing shingles as well as a user determined uniform rise of the shingles so mounted to achieve a desired visual depth or thickness to the roof. The device features an elongated base strap for mounting to the roof line and a plurality of shingle fasteners mounted to the base strap at distances optimal for the shingles being used. Use of adhesives and mechanical mounts for the attached shingle further aids in maintaining a secure mount of the attached shingles in high winds and inclement weather. Optionally, the device can function as an attic vent through venting of attic gasses to the atmosphere through a porus material in the gap between adjoining shingles or exhaust apertures communicating with attic venting apertures through an inner cavity of thee shingle fastener to cool the attic by convection.

19 Claims, 4 Drawing Sheets

DEVICE FOR UNIFORM SHINGLE ATTACHMENT TO ROOF HIP, RIDGE AND BARGE RAFTER

BACKGROUND OF THE INVENTION

1. Field of the Invention

The present invention relates to an roofing and the shingle attachment thereto. More particularly it relates to an device providing an uniform and more secure attachment of shingles to the hip, ridge, and barge rafter portions of shingle roofing which allows for easy in-line installation of such shingles with a user defined spacing and rise.

2. Prior Art

Modern roofing uses a layering system wherein a base of roofing felt is mounted upon a wood roof and then covered by layers of shingles. Shingles mounted in such a manner generally overlap each other with the bottom portion of each shingle mounted to cover the top portion of the next shingle below. This provides a system whereby water running down a roof continuously falls to the upper surface of the next shingle down below its attachment point of that shingle to the roofing felt and underlying roof structure. Since water continuously seeks its own level due to gravity, the water running down a roof never encounters the attache point of the shingle to the roof.

Most residential roofs are constructed with peaks to provide a slant which encourages this downward flow of water. Included in this construction to allow for both aesthetic and construction purposes, are ridges and hips where roofing surfaces on different planes intersect. Covering these intersections of planes of shingles at the hip and ridge effectively is imperative to achieving a water tight element resistant roof structure.

This is because the installation of shingles on a roof is conventionally done from the lowest point on the roof plane being covert to the highest point. Starting at the bottom of the roof plane the installer places rows of shingles. Each successive row of shingles installed covers the top of the prior row in the plane with the bottom portion of the next row higher. This as noted before insures an easy downward path for water whereby the water never encounters the attachment point of the shingle since they are all successively covered by the shingle above.

However, at the top of each plane of a conventional inclined roof, there is an intersection with the other plane or planes of the roof being covered. Such intersections at the peak height of the roof are the conventionally known as the ridge. Intersections of planes of shingles of differing angles at lower points on the roof are known as a hip. These hip and ridge intersections, being at the highest point on each plane of installed shingles, form an intersection point where a gap forms between the two or more intersecting planes of shingles.

To insure that the roof being covered attains a water tight seal, these intersections at the hip and ridge intersections must be adequately covered in a fashion that insures that water hitting the hip and ridge covering shingles proceeds downward on the differing planes of the roof line below. As is obvious, the shingles mounted at the hip and ridge cannot have additional rows mounted higher since they are at a peak already. Thus these shingles must overlap and cover the gap at the intersection of the planes of singles and also be securely mounted upon the hip or ridge.

Aesthetic concerns of modern roofing materials have presented an additional problem in mounting the shingles of hip, ridge and barge rafter intersections with the flat plane of the remainder of the roof. Modern shingles are laminated materials the most popular being fiberglass or asphalt laminated constructions. Such materials, while offering longevity to the roof surface, generally lack sufficient thickness to provide a visual quality of a rise above the adjacent shingle to give the desired visual depth aesthetic quality. Stated differently, the materials of asphalt fiberglass construction, are of such a thin and flat construction, they do not provide the aesthetic quality desired of many homeowners, who in the past have used wood shake or wood shingles which exhibit a stacking that appears thick from the shadows and actual thickness of such wood products.

Further, the shingles currently used to cap hip, ridge, and barge rafter intersections are of a different construction than those used upon the angled planes of the rest of the roof. This is dictated by differing purpose of hip, ridge and barge rafter singles which is to cover the gap formed between intersection planes of the adjacent area of the roof rather than to just cover the shingle below. Such a differing construction requires a different mounting technique to achieve the water proof fit and concurrently reach the aesthetic qualities required.

This differing mounting technique is much harder to master and requires a roofing worker of a higher skill level than a worker installing normal plane mounted shingles. This is because maintaining the hip and ridge mounted shingles in proper line for a water proof mount and achieving the proper line and proper rise for an aesthetically pleasing roof line, is as much an art as a trade. Thus, costs are increased to the roofing contractor due to the level of skill required on hip and ridge intersections, an jobs can become delayed due to lack of skilled help.

Additionally, because the contractor must use different configured shingles on the hip and ridge intersections on the roof planes, those shingles can come from differing dye lots from the shingles used upon the flat plane surfaces of the adjacent planes of shingle roof. Using different dye lots on colored roof is a ticket to aesthetic disaster in that homeowners are generally very particular about how the end result of a roofing job appears since most such roofs are projected to last decades. If the shingles used to cap the hip, ridge or barge rafter intersections are too different in color from the dye lot of the adjacent shingles used on the flat plane surfaces, the roof contractor may be forced to remove and reinstall shingles on the ridge and hip intersections that more closely match the shingles on the roof planes. In the often dim light of late evening and early morning construction work, differing dye lots of the shingles is a constant threat to the aesthetic success of the job at hand.

Finally, modern construction tools have given rise to the pneumatic nail gun which drives nails or staples or similar fastening devices through the shingle into the underlying surface using air pressure. Nails driven in such fashion can be literally driven right through the shingle when using thinner consistency shingles or shingles that are hot from exposure to the sun. Applicant's device as herein disclosed, provides a means for cushioning nail impact and thus prevents nail piercing of the shingle used over Applicant's device.

As such, a need is ever present for a device that would allow for easy in line installation of shingles upon the hip and ridge intersections of shingle covered roof planes.

U.S. Pat. No. 5,247,771 (Poplin) addresses the hip and ridge issue and teaches a ridge shingle unit which is folded back upon itself to achieve a thick appearance. However Poplin still requires the use of special shingles which can differ in dye lots and requires a more skilled laborer to install.

U.S. Pat. No. 5,271,201 (Noone) teaches a specially adapted shingle for covering hip and ridge roof plane intersections. However Noone teaches the use of a specialized shingle for this purpose and also requires a higher skilled laborer to install. The threat of dye lot mis-match as well as increased labor and material costs are not obviated by Noone.

U.S. Pat. No. 5,471,801 (Kupezyk) also teaches the use of a specially configured shingle for covering the intersections of roof planes at the hip and ridge. Kupezyk by design requires a special configuration dictating the use of shingles different from those on the planes adjacent to the hip and ridge. Dye lot mis match as well as increased labor costs for installation of the special shingles are thus still prevalent to Kupezyk.

As such, their exists a need for an easily and inexpensively manufactured apparatus, which can be easily attached to the hip and ridge portions of a shingled roof, which provides for the use of standard shingles as used in the adjacent planes thus lowering costs for special singles and avoiding dye lot mis-match. There exists and additional need for such a device to be easy to mount, and to provide a guide to the user which aids in the proper mount of the shingles of the hip and ridge, thus allowing for the use of lower skilled labor.

SUMMARY OF THE INVENTION

Applicant's device is an easily manufactured and installed fastening apparatus for the attaching of shingles to the hip, ridge, and barge rafter edge portions of a shingled roof. It provides both a mounting guide to aid the user to achieve an in-line installation of conventional roofing shingles as well as a user determined rise of the shingles so mounted to achieve a desired visual depth or thickness to the roof. Applicant's device further aids in maintaining a secure mount of the attached shingles in high winds and inclement weather. Optionally, it can function as an attic vent through venting of attic gasses to the atmosphere and thus help cool the attic and house.

The device consists of an elongated base strap made from flexible or elastic synthetic material such as plastic or fiberglass or similar flexible but strong material.

To the base strap is attached a series of in line "T" shaped shingle fasteners which provide a strong mount for shingles to the ridge, hip, or barge rafter shingles to the roof through their attachment to the base strap or in some cases to the roof, at a mounting end, to their attachment to the shingle at the other end. The shingle fasteners concurrently provide the desired rise of the upper shingle so mounted over the lower through a calculated thickness of the shingle attachment end to achieve a distance between the lower end of one shingle from the upper end of the next lower in line.

Further benefits include increased ventilation of the underlying roof by the calculated and even spacing of the shingles mounted on the shingle fasteners above the shingles mounted below. Additionally, a very secure mount of the shingles attached to the shingle fastener is provided by the shingle fasteners attachment at one end to the base strip, and the use of a hook fastener, adhesive or tar at the distal end, to hold down the gaped end of the shingles mounted on roof ridges, hips, and barge rafters.

Additional function and benefit is provided in cases where aesthetics require the use of shingles to cover the leading edge or barge rafter area of the roof. In an effort to achieve a visual depth of field while still using one dimensions shingles, roofers sometimes cover the leading edges or barge rafters of roofs. Since by design this area was not meant to be covered in such a fashion due to concerns for trapped water causing dry rot, using the shingle fasteners to achieve increased venting and a strong mount helps prevent water damage by allowing built up water to evaporate through the gaps.

Further utility is provided by Applicant's device by through the provision of a means for shock abortion and dampening of the force of nails driven through shingles by high powered pneumatic nail guns or overly zealous workers with a hard driving hammer.

An object of this invention is provide a device which will provide secure mounting of conventional shingles to the hip, ridge, and barge rafter areas of roofs.

Another object of this invention is to provide additional utility by providing a device which will maintain spacing of shingles mounted on the roof and the gaps between overlapping shingles on a roof thus decreasing both the amount and the skill level of labor required to install shingles on a roof.

A further object of this invention is to provide a secure mount to hip, ridge, and barge mounted shingles to better resist damage from wind and wind driven rain and snow.

An Additional object of the is invention is to provide a secure mount to the lower ends of shingles attached to the shingle fasteners using adhesive provided on the mount or providing an aperture for on site application of hot tar or other conventional adhesive.

Another object of this invention is the provision of an easy to use device to maintain the shingles mounted thereon in a relatively straight line without the need for drawing lines on the adjacent roof or other registration methods being employed.

An additional object of this inventions is to allow roofers to use a single dimensioned shingle on both the planer area of the roof and to cap the hip, ridge, and barge rafter areas of the roof and thus forgo the use of more expensive and possible discolored specialty shingles currently used for this purpose.

A still further object of this invention is the provision of a dampener for high velocity or hard hit nails to prevent piercing of the shingle they are driven through.

Further objects of the invention will be brought out in the following part of the specification, wherein detailed description is for the purpose of fully disclosing the invention without placing limitations thereon.

BRIEF DESCRIPTION OF DRAWING FIGURES

Figure 3:
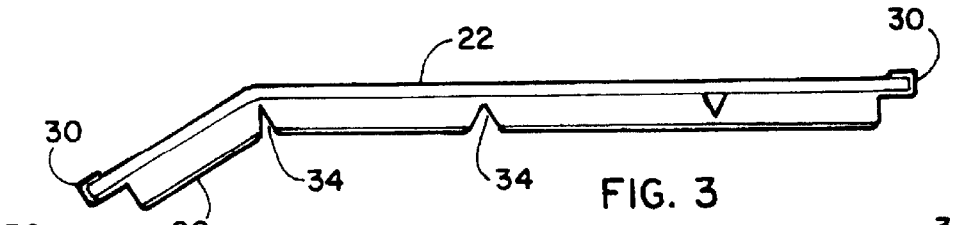
FIG. 3 is an end view of a shingle fastener showing the optional groove and flexible hinge.
Figure 3A:
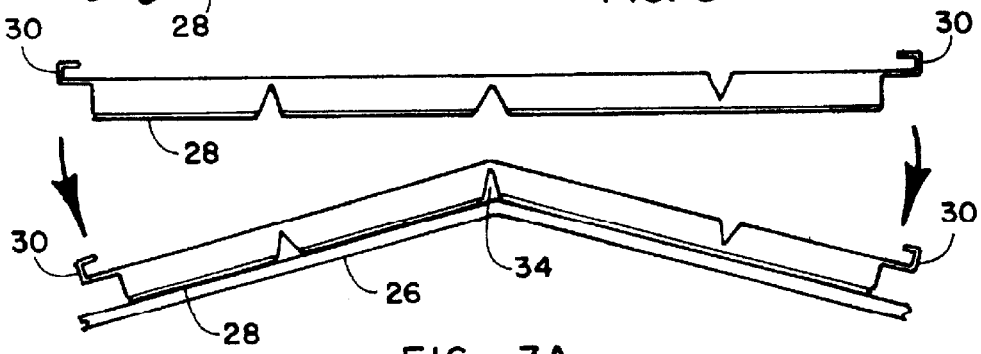

FIG. 3*a* depicts an end view of the grove down the center of the shingle fastener and formed to the ridge of a roof.

Figure 4:
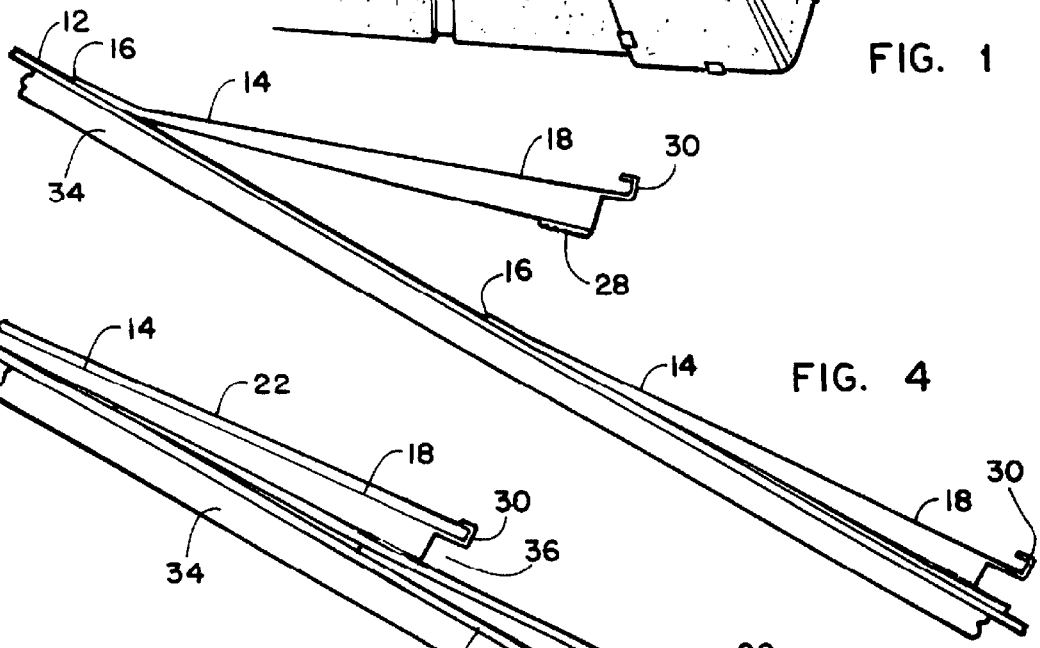

FIG. 4 is a side view of the hip and ridge shingle mounting device.

Figure 5:
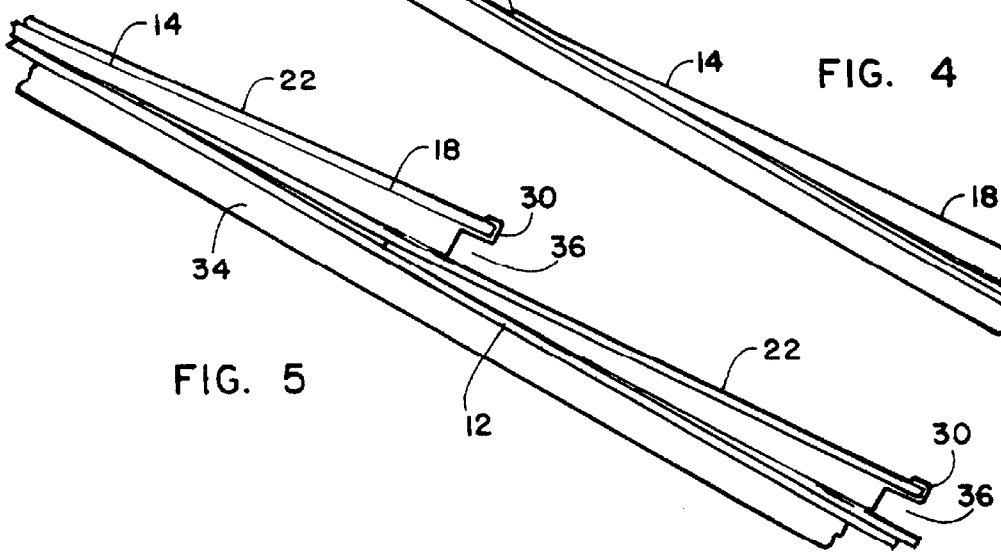

FIG. 5 is a side view of the applicant's roofing hip and ridge shingle mounting device showing shingles attached thereto.

Figure 6:
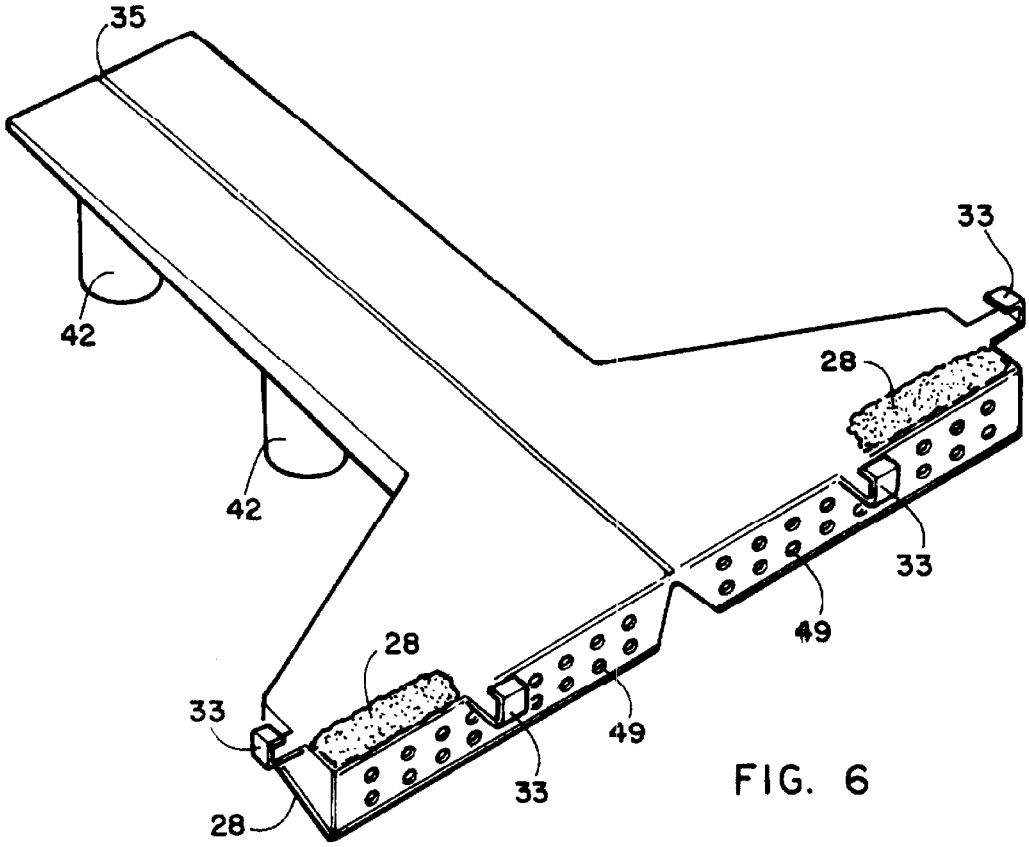

FIG. 6 is a perspective view of a roof venting embodiment of the shingle mounting device.

Figure 7:
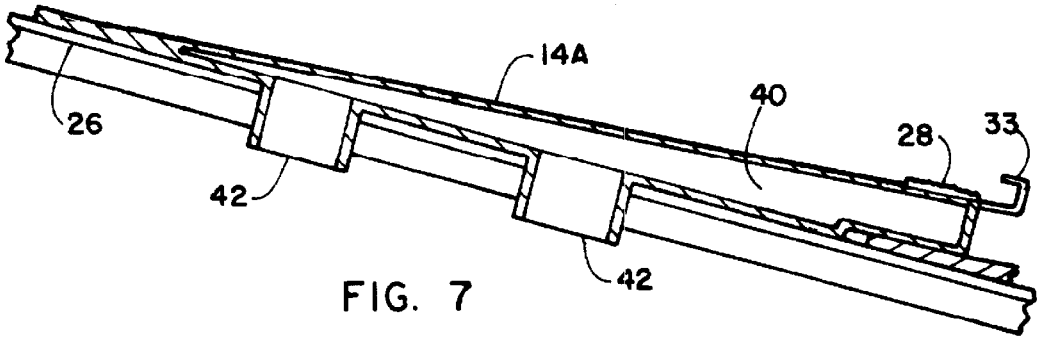

FIG. 7 is a side cut away view of the device in FIG. 6 showing air and condensation flow through the disclosed device.

Figure 8:
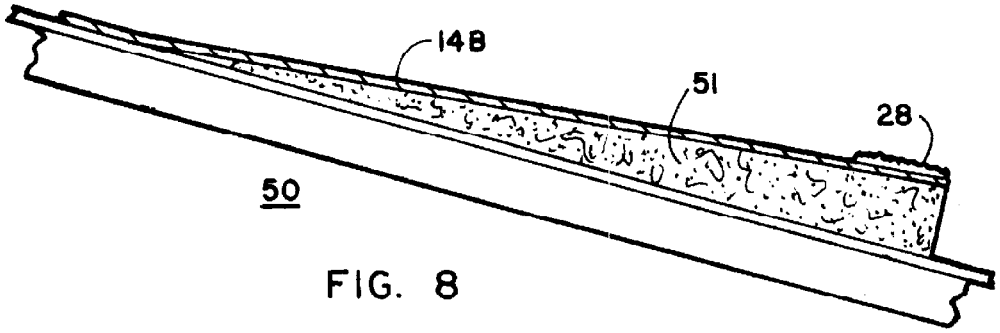

FIG. 8 is a side view of another embodiment of an additional venting embodiment of the device.

Figure 9:
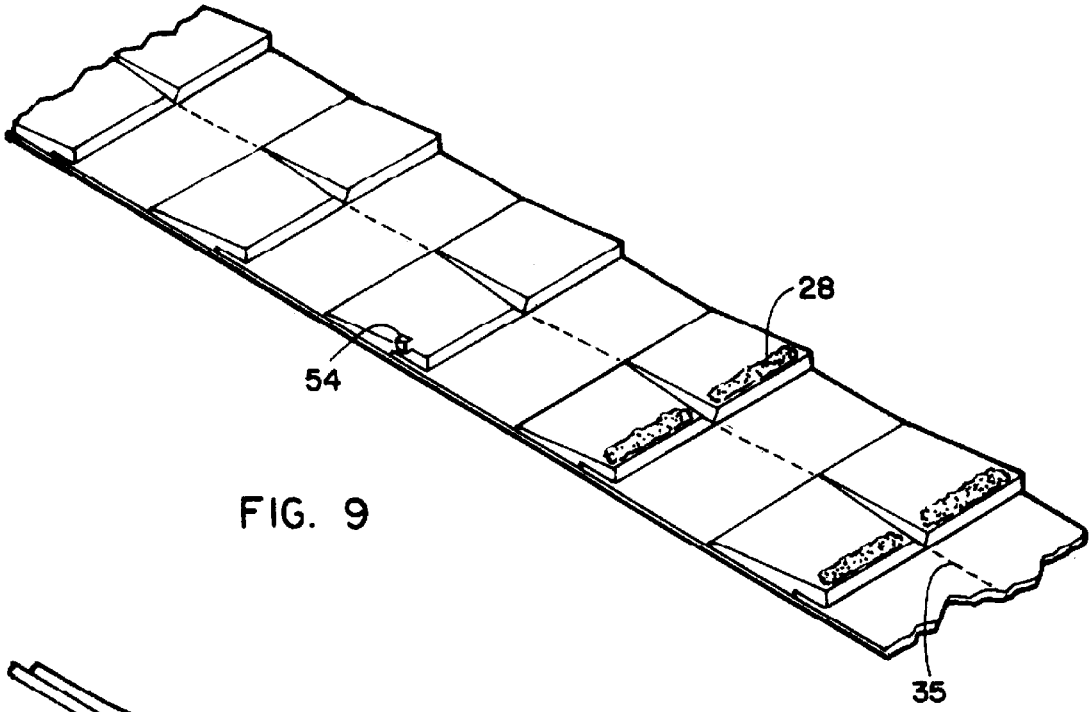

FIG. 9 is a perspective view of another embodiment without a shingle fastener pre-attached.

Figure 10:
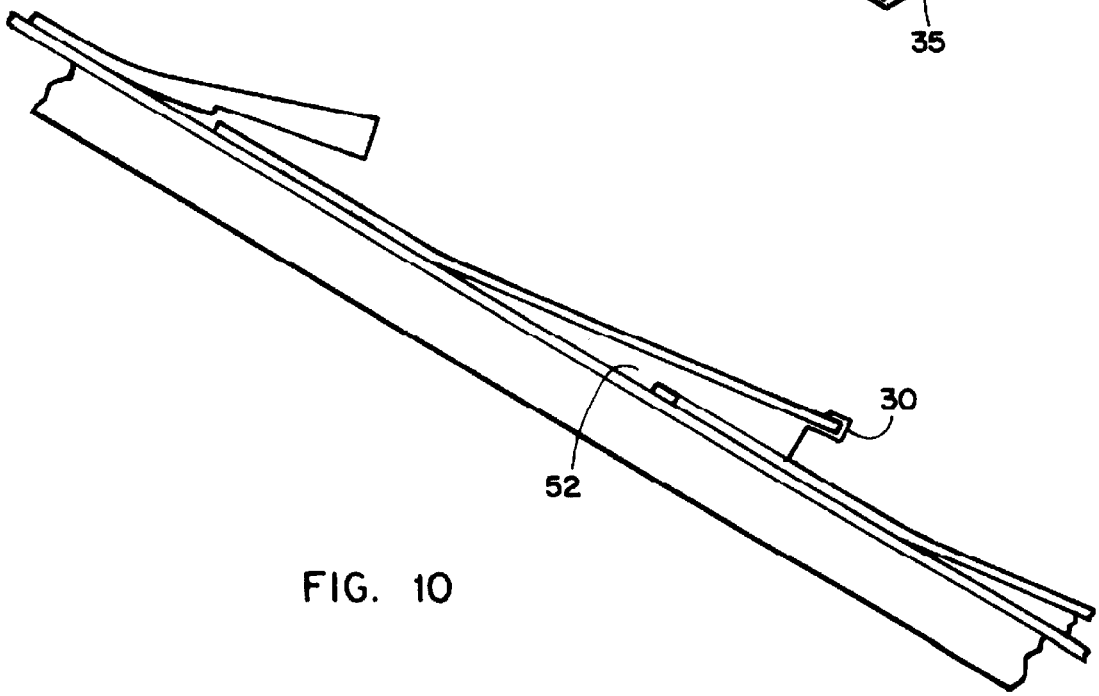

FIG. 10. is a side view of FIG. 9.

DETAILED DESCRIPTION OF THE PREFERRED EMBODIMENTS OF THE INVENTION

Figure 1:
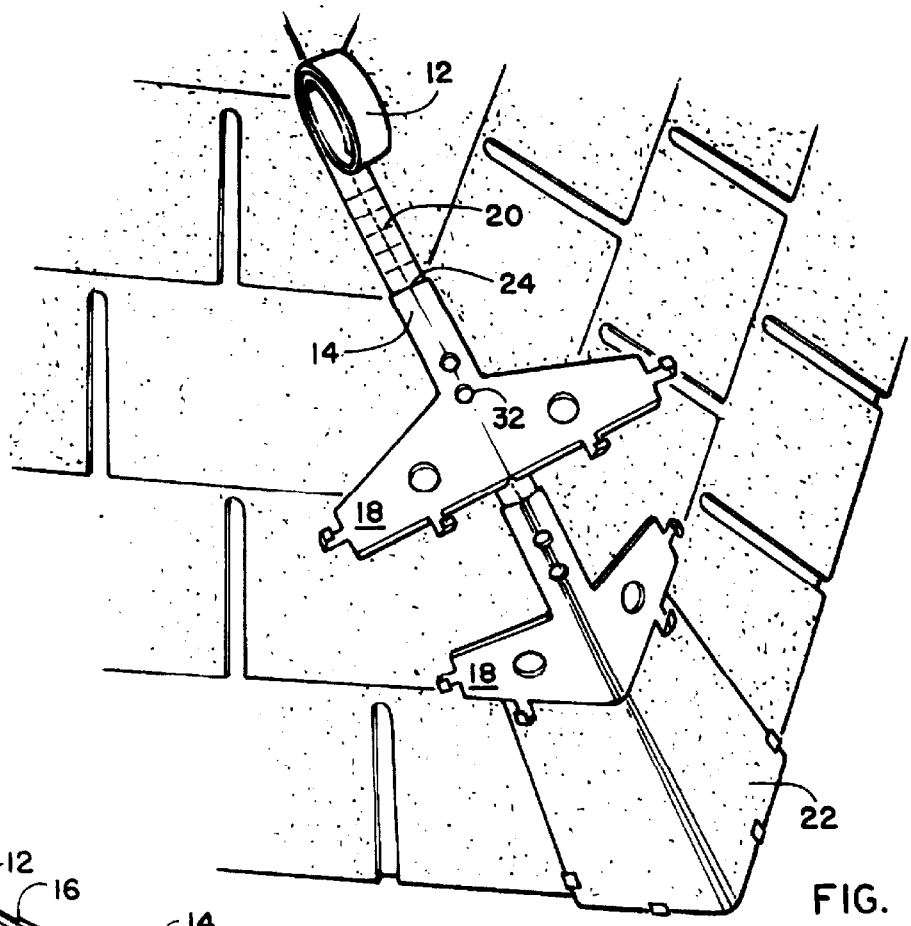
FIG. 1 is a perspective view showing the hip and ridge shingle mounting device showing shingles in phantom line.

Referring now to the drawing Figures, specifically FIGS. 1 through 9 depict the preferred embodiments of the invention. FIG. 1 shows applicant's hip and ridge single mounting device 10 featuring the elongated runner or strap portion 12 which serves as the mount for the shingle fasteners 14. The elongated strap 12 is best constructed from a flexible material such as plastic, webbing, or wire mesh, or treated paper, or combinations thereof, such that when the individual shingle fasteners 14 are attached thereto, separation distance of the shingle fasteners 14 from each is maintained, while the strap is still flexible enough to allow for easy packaging, mounting and storage. Optionally, the elongated strap 12 cold be of a material that is slightly elastic in nature such as a rubber or other plastic or by including such materials as part of the aforementioned materials for construction of the strap 12. This would allow the elongated strap 12 to be stretched to adjust spacing of the shingle fasteners 14 or to aid in mounting by maintaining a slight center bias when mounted at the ends. The elongated strap 12 may also optionally feature indicia 20 upon it to aid in mounting upon the roof and in the spacing of the shingles 22 in a desired spacing. The indica 20 could be adjusted in spacing at the factory for different sized shingles 22 used in combination herewith, and to aid the roofer in achieving the different desired, or required, spacings of the shingles 22.

Figure 2:
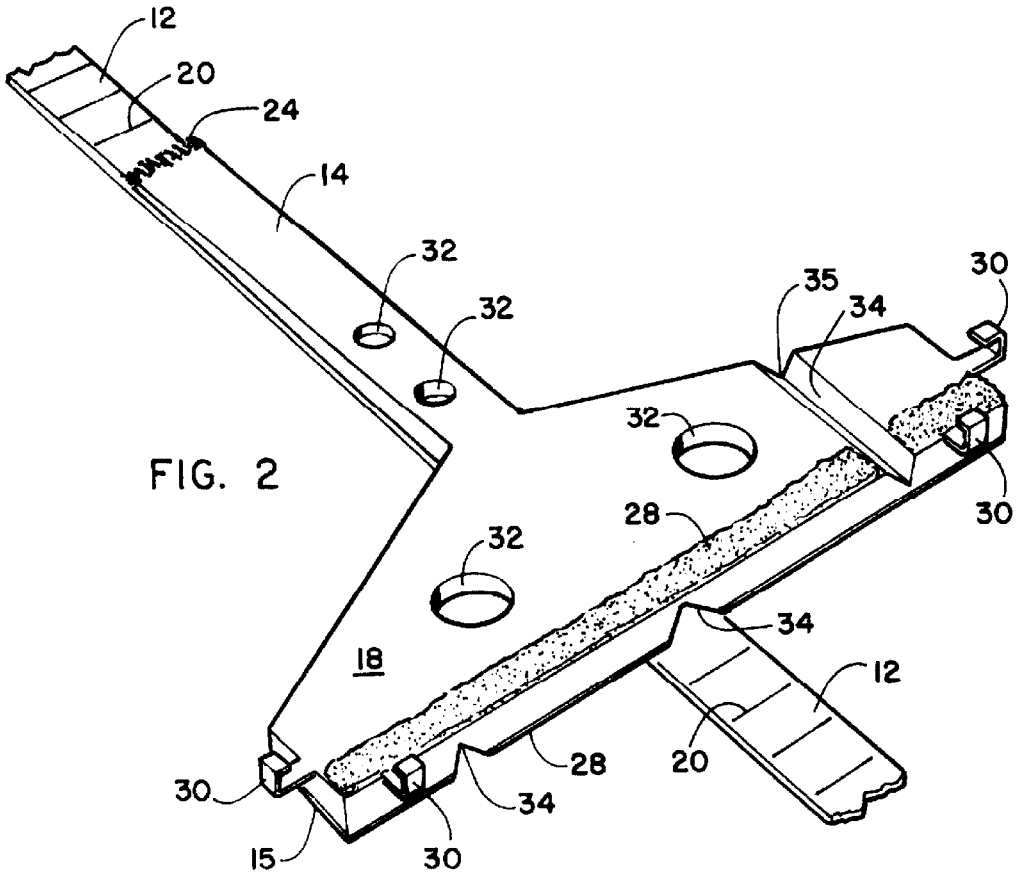
FIG. 2 is a perspective view showing a shingle fastener attached to the elongated strap.

FIG. 2 depicts the shingle fastener 14 which is attached at a mounting end 16 to the elongated strap 12 and remains free from attachment until final installation at the attachment end 18 of the shingle fastener 14. Mounting the shingle fastener 14 to the elongated strap 12 at the mounting end 16 may be accomplished in any conventional means of attachment 24 such as the use of adhesive, heat sealing, staples, or the use of conventional fasteners so long as the elongated strap 12 is securely mounted to the shingle fastener 14. This mounting is currently best performed during the manufacturing process such that the device may be supplied as a roll or folded elongated strap to the roofer, for use in dimensions as needed, by pulling it off of the roll or out of a box where it is folded for shipment. The roofer could thus buy a large quantity of the preassembled strap 12 and shingle fasteners 14 which would be properly spaced on the strap 12 at the factory to mount the specific shingles for which it would be intended. Such a properly spaced attachment of the shingle fasteners 14 would allow for insertion of the upper end of the shingle to the a stopping point where the shingle fastener 14 attaches to the elongated strap 12 and place the lower end of the shingle in proper overlap with the upper end of the shingle below. In that manner, very exacting spacing and overlap of the shingles used in combination herewith is achieved even by the least experienced personnel mounting the shingles. This is because the junction of the shingle fastener 14 and the elongated strap 12 serves as a stop for the upper end of the shingle at a point where the optimum overhang of the lower end of the shingle is achieved.

In use the roofer could just roll out a sufficient-amount of the pre-assembled strap 12 with shingle fasteners 14 attached in the proper spacing for the shingles 22 being used on the job, and attach the elongated base strap 12 to the roof over the ridge, hip, or at the roof edge. The upper end of the cut piece of pre-assembled base strap 12 with shingle fasteners 14 is attached, and then stretching the other end in a straight line, much like a plum line, the roofer can then attach the other end in the proper spot on the roof and cut off the excess. The result being an extremely straight mounting of the base strap 12 and the pre-attached shingle fasteners 14 such that it is especially easy to subsequently insert the singles under the shingle fasteners 14 to a point where the shingles stop on the upper end and over lap the shingle below at the other end. It is also easy to maintain a straight line of the attached shingles so attached since the base strap 12 would is already mounted in a straight fashion on the roof and the fasteners 14 are perpendicular to the base strap 12.

It is however anticipated that individual shingle fasteners 14 which are not pre-attached to the base strap 12 could also be used should special spacing or repair or other reason arise where in line even spaced attachment to the base strap 12 is not desired. This would occur when a repair is being done to the roof and only one or a few of the hip or ridge shingles are being replaced, or, if some special spacing for aesthetics or construction may be required or desired. In such cases the individual shingle fasteners 14 not pre attached, could be stored in boxes for use when needed. The current best mode for most roof construction and which would allow for the easiest in-line and appropriately spaced and overlapped shingles 22, features the shingle fasteners 14 attached to the elongated base strap 12 in most instances. This embodiment also allows for the use of less skilled roofing workers since the proper spacing and rise of the shingles to be used in combination would pre-determined by the pre-assembly of the shingle fasteners 14 to the elongated base strap 12.

The optional addition of indicia 20 could be added to provide the roofer with some frame of reference of measurements and spacing should such be desired for the materials being used, however, if the shingle fasteners 14 are mounted upon the base strap 12 and properly spaced from each other, the indicia 20 would not be necessary. Currently, attachment of the shingle fasteners 14 to the strap 12 is best achieved in measurements for use with conventional shingles, such that the attachment ends 18 are equally spaced from each other at a distance from about four inches to thirteen inches, depending on the size of the conventional shingle used and the overlap required by the building code. However, there is an infinite number of separation pre set separation distances that can be achieved by simply attaching the fastener 14 to the base strap 12 to achieve the required mount or desired aesthetic qualities. Therefor should new shingle sizes arise in the industry or the desired overlap of shingles be different, then the spacing of the factory mounting of the shingle fasteners 14 to the base strap 12 could be changed to an infinite number of separation distances, either of equal or unequal spacing, to achieve the optimum spacing of the shingle fasteners for the desired shingle 22 mounting.

The attachment end 18 of the shingle fastener 14 is depicted as perpendicular to the elongated mounting end 16 such that a "T" shape is formed. Of course the attachment end 18 might also be attached in other than perpendicular angles such as a "Y" or other shapes if desired, but the current best mode of this embodiment features such a perpendicular relationship since that is the easiest for the user to relate to the straight lines of conventional shingles. The attachment end 18 provides for a means of attachment of the lower or distal end of the shingle 22 to the underlying roof 26 thereby providing a very strong mount of the lower end of the shingle 22 which heretofore might have been left unattached. Conventionally, shingles 22 are nailed, stapled, or otherwise fastened to the underlying roof at their upper end on an inclined roof. The lower or distal end of conventional shingles 22 on a roof line are not attached and just overhang the next shingle 22 down with a gap in between the two shingles. This gap and poor attachment provides an ideal combination for high winds to lift and damage the shingles, or, to force water upward, causing leaks in the underlying roof. The device as herein disclosed solves this dilemma by the provision a number of means to secure the distal end of shingles 22 which can either be used singularly or in combination, depending on the degree of securement desired, to secure the distal end of the single 22 to the shingle fastener 14, which is in turn is attached to the underlying material on the roof. The current best mode for this distal end shingle attachment include one or a combination of, adhesive strips 28, edge hooks or stops 30, deposit cavities 32 for the location and deposit therein on the job of roofing tar or similar conventional roof adhesives. Combinations of these different shingle distal end securements may be used depending on the type of conventional shingles 22 used and the desired degree of securement. Of course advances in adhesive technology may yield additional types of attachment material and such material would be anticipated in addition to the aforementioned current best mode.

All of the various securing devices can be factory mounted to allow the roofer to use the best method for the job at hand to secure the shingle 22 and the attachment end 18 of the shingle fastener 14.

In use, the shingle stops 30 which would resemble a hook, could be used with the tar or adhesive or separately and hooked over the side edges and/or the lower end of the shingle 22 being mounted to provide an especially secure means of attachment of the distal end of the shingle that will resist rising in high winds. The adhesive strips 28 may be placed on the bottom side 15 of the fastener 14 to provide a means of attachment to the roof surface of the attachment end 18 of the fastener 14 and/or on the top side 17 of the shingle fastener 14 to provide for attachment of the lower end or overhanging end of the shingle 22 thereto. Conventional peel and stick adhesive strips or pressure sensitive adhesive which activates when pressure is applied would best be used wherever adhesive strips are desired for use for ease of operation and application however, roofing tar might also be applied in these regions should the roofer desire such attachment, or nails or staples could be used depending on the building code requirements and the degree of securement desired of the distal end of the shingle 22 and the attachment end 18 of the fastener 14.

Finally, another means of securing the distal end of the shingle 22 to the attachment end 18 is allowed for by the provision of deposit cavities 32 in the shingle fastener 14 can provide a repository for hot tar or roofing mastic or other conventionally used roofing adhesives to be deposited therein and later covered with the shingle 22 which will then adhere to the roofing adhesive for a sturdy mount. Currently, the easiest and most labor saving embodiment would be provided by the used of factory attached adhesive strips 28 but building codes or the desire for additional securement may require the use of one or more of the aforementioned additional means of securement.

Aesthetic qualities of the roof such as the depth or three-dimensional appearance are aided by the rise over the next lower shingle 22 when mounted in the conventional overlapping fashion. The device herein disclosed provides a means for mounting with a uniform rise of a the distal end of a shingle above an adjacent shingle by the provision of a constant or uniform total thickness of the attachment end 18. This determination is best done during manufacture since the shingle fasteners 14 would best come mounted to the base strap 12 in rolls or boxes of assembled product. The adhesive strip 28 on the bottom side 15 and top side of attachment end 18 of the shingle fastener 14 could also be adjusted in thickness to provide more, or less, rise of the above mounted shingle, as desired for the look, or construction intended. The result being that pre determination of the total thickness of the attachment end 18 with any adhesive strips 28 attached to the top or bottom sides, will thus provide a means for a uniform rise of the shingles above each other while concurrently providing a very secure mount of the lower end of the shingles so attached.

The provision of optional grooves 34 in the elongated attachment end 18 of the shingle fastener 14 provides great additional utility when the device is used over a barge rafter area of a roof where only one side of the shingle is conventionally bent to provide depth to the roof edge. Currently shingles in such use are just mounted over the top of the roof edge and onto the facie in a method that can cause dry rot and water retention problems.

For mounting over steep angles or on roof edges where a slope of the shingle is desired, applicant's device optionally provides a score or groove 34 to allow the user to separate or bend the elongated mounting end 16 and the attachment end 18 to cover the roof edge or peak and provide a very secure mount using the aforementioned adhesive or shingle straps or combinations thereof. A flexible material such as paper or plastic, attached on one of the upper or lower sides of the shingle fastener 14, or by only notching the shingle fastener 14 mounting end 16 and attachment end 18 partially, would form a flexible hinge 35 to hold the two pieces of the shingle fastener 14 and or the mounting end 16 together for placement over the angle, while providing a seal over the cracks in such installations at the same time. By providing for a rise or gap 36 between the underlying shingles 22 at the edge of the roof, the risk of dry rot which currently occurs to the facie when the shingles are just attached thereto on one edge, is greatly reduced.

FIGS. 6 through 8 show venting embodiments 14*a* and 14*b* of the device. These embodiments, in addition to the aforementioned in-line and spacing, uniform rise, and shingle registration, also provide a means for venting of the attic. Such venting of hot and humid attic gases is provided by shingle fastener 14*a* having a hollow inner cavity 40 and venting apertures 42 which communicate with and through the inner cavity 40 which in turn communicates with the exhaust apertures 49. When mounted upon a roof 26 using the adhesive strips 28 or the other aforementioned means for mounting the venting apertures 42 are spaced to fit through the conventional gap that exists in the underlying structure of many shingle roofs. The venting apertures 42 thus communicate with the attic 50 under the roof 26. Of course holes could be drilled in roofs with solid sheeting which lacks the gaps that exist in a great majority of conventional shingle roofs built in recent decades and thereby provide a means for communication of the venting apertures 42 with the attic.

Or, as depicted in shingle attachment 14*b* the venting could also be achieved, along with the desired gap 36 by the attachment to the bottom surface of the shingle attachment

14*b* of a porus breathable material 50 which will breath or allow communication of air therethrough from the attic to the atmosphere. In this embodiment, the bottom surface of the shingle attachment 14*b* faces the gaps or holes in most roof surfaces that communicate with the attic and thus will allow the breathable material 50 to communicate hot or humid air in the attic through the these gaps in the underlying roof and to the atmosphere through the gap 36 under the overhand of the distal end of the attached shingle 22.

When used on conventional roofs these venting embodiments provide and excellent means for venting the heat which builds up in the attic 52 of most homes. Heat in the conventional attic naturally rises into the communicating venting apertures 42 and therein travels through the communicating inner cavity 40 to be expelled through the communicating exhaust apertures 49 to the atmosphere. This embodiment would be especially useful to provide the aforementioned mounting and spacing for shingles 22 used herewith, while concurrently providing the additional benefit of a means for venting heat build up which naturally forms in the attic without the need for exhaust fans, or other manner of venting. By just using natural convection and providing a flow channel to communicate the heat and condensation from the attic through the gaps great energy is saved as well as damage from condensation by venting the attic during hot months.

FIG. 8 is a side view of the venting embodiment of the showing the optional flexible hinge 35 to allow the venting shingle mounting device to traverse over ridge angles. The flexible hinge 35 is attached to two pieces which make up the body 45 of the venting mount 44 only in this case the body 45 would be formed in a manner such as two mirrored pieces that when attached together by the flexible hinge 35 would yield the proper shape. As is obvious this optional flexible hinge 35 allows the user to place the device over the top of the roof ridge formed at two intersecting planes of the roof 26 and provide a mount parallel to each plane of the roof 26. Further advantage is gained by the continuous upper surface area on one side of the mount providing a water tight seal underneath the overlying shingle over the top. These venting embodiments of the shingle fasteners 14*a* and 14*b* an be mounted upon the elongated base strap 12 and combined with adhesive and the aforementioned mounting techniques, or, they could be individually substituted for shingle non vented fasteners 14 to provide an occasional vent to the attic.

In the event that pre-attached fasteners 14 are not desired due to cost, an embodiment of the device which will still provide a uniform rise above the shingles below, and uniform spacing of the shingles from each other is shown in FIG. 9. In this embodiment the elongated base strap 12 would feature an optional score or groove 34 at its mid section such that the strap 12 could bend easily over the angled planes of the roof sections. The uniform rise of the shingles over is provided by the a shingle riser 52 which can be wood or plastic material of the desired thickness to yield the proper rise, or can be provided by a proper thickness of adhesive strip 35 which is separated initially from permanent adhesion to the base 12 and which will double as a the mount for the lower end of the shingle. In this embodiment the shingle riser 52 would be attached to the base strap 12 on a side edge or in another position using a clip 54 or similar attachment that will allow the upper edge of the shingle below to be inserted under the riser 52. Thereafter the top edge of the shingle would be nailed or stapled in place and the lower edges of all the shingles will have a uniform rise as determined by the thickness of the riser 52. If adhesive tape were used as the riser 52 it would be attached at a side edge to the base strap 12 and either be adhesive in nature on the surface facing the bottom of the shingle or pressure activated on the surface facing the base strap to provide the ability to slide the upper part of the lower shingle under between the base 12 and the riser 52. This embodiment would be the least expensive to manufacture and provide a uniform rise but the most secure mount would be achieved by the aforementioned embodiments using the fastener 14.

While all of the fundamental characteristics and features of the herein disclosed device for shingle attachment have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An apparatus for use in combination with roofing shingles for attachment of said shingles to a roof, comprising:

a shingle fastener, said shingle fastener being substantially T shaped, said shingle fastener having a mounting end for attachment of said shingle fastener to a roof, and an elongated attachment end substantially normal to said mounting end, for attaching said shingle fastener to the substantially the entire width of the distal end of a shingle used in combination herewith;

means for attachment of said mounting end to said roof;

means for attachment of said attachment end to said distal end of said shingle; and means to provide a uniform rise of said distal end of said shingle above an adjacent shingle forming a gap therebetween.

2. The apparatus as defined in claim 1, additionally comprising:

said means for attachment of said mounting end to said roof being one or a combination of a group consisting of adhesive strips, adhesive, nails, staples, mastic, and roofing tar.

3. The apparatus as defined in claim 1 additional comprising:

said means for attachment of said attachment end to said distal end of said shingle constituting one or a combination of attachment devices from a group consisting of adhesive strips, adhesive, and fastening hooks.

4. The apparatus as defined in claim 1 wherein said gap formed by said means to provide a uniform rise of said distal end of said shingle above an adjacent shingle forming a gap therebetween is defined by the total thickness of said attachment end.

5. The device as defined in claim 1, additionally comprising a means for communicating air from an attic to the atmosphere.

6. The device as defined in claim 5 wherein said means for communicating air from an attic to the atmosphere comprises:

breathable material mounted to the bottom surface of said shingle fastener, said breathable material capable of communicating air therethrough from an attic to said atmosphere when said shingle fastener is attached to said roof.

7. The device as defined in claim 5 wherein said means for communicating air from an attic is provided by said shingle fastener having a venting aperture communicating with an exhaust aperture through an inner cavity of said shingle fastener whereby air from said attic is communicated through said venting aperture to said exhaust aperture when said shingle fastener is mounted to a roof.

8. An apparatus for use in combination with roofing shingles for attachment of said shingles to a roof, comprising:

an elongated flexible base;

a plurality of generally T shaped shingle fasteners each having a mounting end, an attachment end substantially equal in width to the distal end of a shingle used in combination herewith positioned distal to said mounting end, an upper surface, and a lower surface, each of said plurality of shingle fasteners attached to said elongated flexible base at said mounting end at a calculated spacing from adjacent shingle fasteners with said mounting end substantially parallel with said flexible base and said attachment end perpendicular thereto;

means for attachment of said elongated flexible base to said roof; and means for attachment of said attachment end of said shingle fastener to said distal end of said shingle.

9. The apparatus as defined in claim 8 additionally comprising said means for attachment of said attachment end to the distal end of said shingle consists of one or a combination of attachment devices from a group consisting of adhesive strips, adhesive, and fastening hooks.

10. The apparatus as defined in claim 8 additionally comprising a means to provide a uniform rise of said distal end of said shingle above an adjacent shingle.

11. The device as defined in claim 8, additionally comprising a means for communicating air from an attic to the atmosphere when said elongated base and said plurality of shingle fasteners are attached to a roof.

12. The device as defined in claim 11 wherein said means for communicating air from an attic to the atmosphere comprises porus breathable material mounted to the bottom surface of said shingle fastener for communicating air from said attic through a gap formed by said material between adjacent shingle fasteners when said elongated flexible base and said shingle fasteners are operably attached to a roof.

13. The device as defined in claim 11 wherein said means for communicating air from an attic is comprised of a venting aperture communicating with an exhaust aperture through an inner cavity of located in each of said plurality of shingle fasteners whereby air from said attic is communicated through said venting aperture to said exhaust aperture when said elongated flexible base and said plurality of shingle fasteners are operable attached to roof.

14. The apparatus as defined in claim 10 whereby said means to provide a uniform rise of said distal end of said shingle above an adjacent shingle is provided by a calculated total thickness of each of said mounting ends of said shingle fasteners.

15. The apparatus as defined in claim 8 wherein said calculated spacing from adjacent shingle fasteners upon said base is infinitely adjustable to accommodate any size shingles.

16. The apparatus as defined in claim 8 wherein said spacing of said mounting of said plurality of shingle fasteners yields said attachment ends at an equal distance from each other said equal distance being from four inches to thirteen inches.

17. The apparatus as defined in claim 8 configured in a long strip and rolled up for disbursement as needed, said disbursement accomplished by pulling a desired length from said long strip and cutting said elongated base to yield the desired length of elongated flexible base with the desired number of attached shingle fasteners.

18. The apparatus as defined in claim 16 configured in a long strip and rolled up for disbursement as needed, said disbursement accomplished by pulling a desired length from said long strip and cutting said elongated flexible base to yield the desired length of elongated flexible base with the desired number of attached shingle fasteners.

19. The apparatus as defined in claim 8 additionally comprising indicia on said elongated base.

* * * * *